United States Patent [19]

Grignon

[11] Patent Number: 4,482,302

[45] Date of Patent: Nov. 13, 1984

[54] AXIAL ELECTRIC FAN OF THE FLAT TYPE

[75] Inventor: Robert Grignon, Verrieres Le Buisson, France

[73] Assignee: Etudes Techniques et Representations Industrielles E.T.R.I., Neuilly sur Seine, France

[21] Appl. No.: 335,570

[22] Filed: Dec. 29, 1981

[30] Foreign Application Priority Data

Jan. 9, 1981 [FR] France ..... 81 00257

[51] Int. Cl.[3] ..... F04D 29/52

[52] U.S. Cl. ..... 417/354; 415/182

[58] Field of Search ..... 415/219 R, 216, 217, 415/191, 192, 119, 182; 417/352, 353, 354, 423 R

[56] References Cited

U.S. PATENT DOCUMENTS

| | | | |
|---|---|---|---|
| 2,735,611 | 2/1956 | McLean | 415/119 |
| 2,926,838 | 3/1960 | Van Rijn | 417/354 |
| 3,237,849 | 3/1966 | Krell | 417/353 |
| 3,362,627 | 1/1968 | Papst | 417/354 |
| 3,644,066 | 2/1972 | Heob et al. | 417/354 |
| 4,167,376 | 9/1979 | Papst | 415/192 |
| 4,221,546 | 9/1980 | Papst et al. | 417/354 |
| 4,345,874 | 8/1982 | Ozeki et al. | 415/219 R |

FOREIGN PATENT DOCUMENTS

| | | | |
|---|---|---|---|
| 2151400 | 4/1973 | France . | |
| 2291384 | 6/1976 | France . | |
| 2414649 | 9/1979 | France | 417/353 |
| 608708 | 9/1960 | Italy | 417/353 |

*Primary Examiner*—Louis J. Casaregola
*Assistant Examiner*—Jeffrey A. Simenauer
*Attorney, Agent, or Firm*—Young & Thompson

[57] ABSTRACT

The cross-sectional area of the airflow duct on at least one face of the fan housing is larger than the cross-sectional area of a cylindrical portion of duct which cooperates with the impeller. A junction portion having an S-shaped cross-section in an axial plane is provided on at least part of the duct periphery between the cylindrical portion and that housing face. The fan duct progressively increases in width from the cylindrical portion to the housing face and the S-shaped junction portion has a point of inflection substantially at the midpoint of its axial length. A reduction in noise level is thus achieved during operation of the fan.

12 Claims, 16 Drawing Figures

AXIAL ELECTRIC FAN OF THE FLAT TYPE

This invention relates to an axial electric fan of the flat type in which the axial dimension is substantially shorter than the transverse dimension.

Flat axial fans are often employed for ventilation and cooling of grouped electric and electronic circuits which are provided in particular in computers.

A fan of this type comprises a housing which is intended to be mounted on the wall of an equipment console which contains the circuits. The fan housing has an air admission face and an air outlet face which is usually of square shape in order to conform to the front face of the console. Provision is made between the two faces of the fan housing for a cylindrical duct containing an impeller which is mounted on the drive shaft of a motor contained within a casing, the motor casing being attached to the fan housing by means of a number of supporting arms. On at least one face of the fan housing, the airflow cross-section has a larger area than the cross-section in which the impeller is located.

The joining together of the different cross-sections has given rise to aerodynamic studies with a view to achieving optimum energy efficiency.

A new type of problem has arisen, however, from the need to equip office computers with cooling fans. It has in fact been found in practice that relatively silent operation is a prime requirement and fans of known types usually fail to satisfy this condition.

The aim of the present invention is to provide a fan of the type contemplated in the foregoing, in which the operation of the fan is accompanied by an appreciably reduced level of noise, this result being achieved irrespective of the direction of flow of the air relative to the fan-motor attachment arms.

In accordance with the invention, the axial electric fan of the flat type comprises a housing designed for mounting on a wall and having an air admission face and an air outlet face, provision being made within said fan housing for a duct having a cylindrical portion adapted to cooperate with an impeller mounted on the shaft of a motor contained within a casing which is attached to the fan housing by means of a number of supporting arms. The cross-sectional area of the duct on at least one face of the fan housing is larger than the cross-sectional area of the cylindrical portion of duct which cooperates with said impeller. The distinguishing feature of the fan lies in the fact that the duct is provided on at least part of its periphery between its cylindrical portion and the aforesaid face of the fan housing with a junction portion having an S-shaped profile in an axial plane, the ends of the S being substantially parallel to the axis of rotation of the impeller. The fan duct progressively increases in width from its cylindrical portion which cooperates with the impeller to the aforesaid face of the fan housing and the S-shaped profile of the junction portion has a point of inflection located substantially at the midpoint of the axial length of the junction portion.

It has been found that a junction portion of duct of the type described in the foregoing produces a considerable reduction of noise, whether said portion is provided on the intake side or on the discharge side or even on both faces.

In a preferred embodiment of the invention, the junction portion terminates in the cylindrical portion of the duct substantially at the level of the impeller-blade edges located nearest the aforesaid face of the fan housing; the S-shaped section has a point of inflection located substantially at the midpoint of the axial length of the junction portion; the arms which support the fan-motor casing are approximately tangent to the plane containing the largest cross-sectional area of the junction portion and extend towards the interior of the fan housing over approximately three-quarters of the axial length of the junction portion.

Under these conditions, at least if the fan-housing face considered is the air admission face, the air impinges on the one hand on the supporting arms and on the other hand on the leading edges of the impeller blades in a zone in which the airflow acceleration is substantially zero, thus producing a noise-attenuating effect.

In an advantageous embodiment of the invention, the arms which support the fan motor casing have a decreasing cross-section from the aforesaid face of the fan housing to the impeller and the point of inflection of the S-shaped section is located approximately at two-thirds of the cross-sectional length of the supporting arms along the axis of the fan starting from the plane of maximum cross-sectional area of the junction portion.

The point of the supporting arms just mentioned corresponds to the point at which the airstream filaments tend to break away from the surface of said arms. The fact that said point is placed opposite to the point of inflection at which the airflow acceleration is of maximum value tends to inhibit this tendency toward breakaway.

In an alternative embodiment, the point of inflection of the S-shaped section is located at a point corresponding approximately to at least double the cross-sectional length of the supporting arms along the axis of the fan starting from the plane of maximum cross-sectional area of the junction portion.

Under these conditions, disturbance of the airflow caused by the presence of the supporting arms takes place within a zone in which the acceleration is low and which is at the same time located at a distance from the edges of the impeller blades.

These and other features of the invention will be more apparent to those versed in the art upon consideration of the following description and accompanying drawings, wherein.

Figure 1:
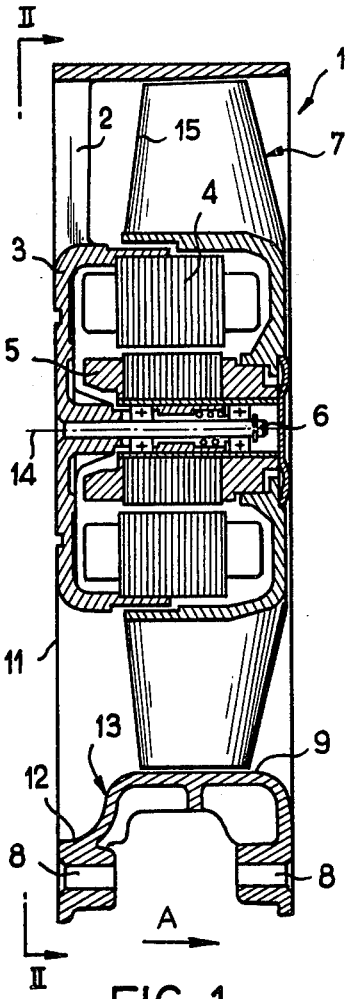
FIG. 1 is a view in axial cross-section taken along line I—I of FIG. 2 and showing a fan according to the invention, in which the S-shaped junction portion is located on the intake side.
Figure 2:
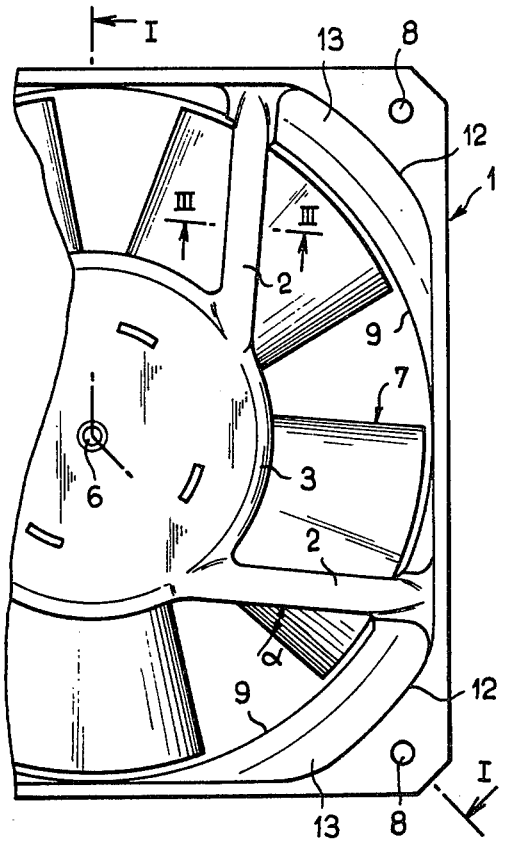
FIG. 2 is a view taken along line II—II of FIG. 1.

Referring first to FIGS. 1 and 2, the fan comprises a housing 1 provided on the intake side with a number of supporting arms 2 to which is attached a casing 3 containing a motor composed of a stator 4 and a rotor 5. The stator 4 is secured to the motor casing 3 whilst the rotor 5 is rotatably mounted on a shaft 6 which is secured to the same casing. An impeller 7 is fixed on the rotor 5.

Figure 4:
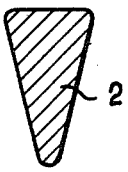
FIGS. 3 and 4 are views in cross-section of two possible alternative embodiments of a supporting arm, this view being taken along line III—III of FIG. 2.
Figure 3:
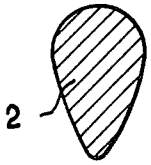

The supporting arms 2 are profiled and have a right cross-section which decreases in width from the face 11 toward the impeller 7, at least in the vicinity of the point of inflection 16. That is to say that said cross-section increases between said point of inflection and the edge of the fan housing. Said cross-section is either of ovoid shape (as shown in FIG. 3) or of triangular shape (as shown in FIG. 4), the portion of maximum width being located on the intake side.

The fan housing 1 has a substantially square external shape and is provided at its four corners with holes 8 for mounting in position in a supporting wall. The interior of said fan housing constitutes a duct which is cylindrical in the duct portion 9 which cooperates with the impeller 7.

The fan housing 1 opens to the intake through its air admission face 11. In the plane of said face, the cross-section 12 of the duct is larger than the cross-section of the cylindrical portion 9 and tends to come closer to the square external shape of the fan housing.

The airflow cross-section 12 is joined to the cylindrical airflow cross-section 9 by means of a junction portion 13 which will now be described in detail with reference to FIG. 5 and which has an S-shaped profile in the axial plane of FIGS. 1 and 5.

The ends of the S-shaped profile are parallel to the axis 14 of rotation of the impeller 7, then joined on the one hand to the inlet section 12 in a direction parallel to the direction A of the airstream filaments and on the other hand to the cylindrical portion 9. The profile 13 is joined to the cylindrical portion 9 substantially at the level of the leading edges 15 of the impeller blades.

The S-shaped profile is composed of two arcs, one of which is continuously concave towards the axis 14 of the fan whilst the other arc is continuously convex towards said axis. These arcs are joined to each other by means of a point of inflection 16.

In the example herein described, said arcs are circular arcs and the two radii of curvature R are equal. In consequence, the point of inflection 16 is located at the midpoint of the axial length X of the junction portion.

The suporting arms 2 extend in a plane parallel to the plane of the air admission face 11 and the front side of said arms is substantially contiguous to the plane of the air admission face 11, said face 11 containing the largest cross section 12 of the junction portion and said arms extend towards the interior of the fan housing to approximately three-quarters of the axial length of the junction portion 13 ($L=\frac{3}{4}X$).

It follows from the foregoing that the point of inflection 16 is located at two-thirds of the cross-sectional length L of the arm 2 along the axis of the fan, starting from the plane 11 of maximum cross-section of the junction portion ($x_1=\frac{2}{3}L$).

Finally, the supporting arms 2 are not radial arms but are displaced off-center and are thus always inclined at a nonzero angle $\alpha$ with respect to the edges of the impeller blades (as shown in FIG. 2) when said edges pass in front of said arms.

During operation of the fan, the air which flows in the direction of the arrow A initially impinges on the supporting arms 2, the point of impact being located within the air admission face 11. In this region, the profile of the junction portion 13 is parallel to the axis 14 of the fan, with the result that the air velocity is constant with zero acceleration in said region.

These conditions are identical in the region of impact of the air on the leading edges 15 of the impeller.

The zero acceleration of the airflow in the impact regions produces a substantial reduction in the level of noise. This reduction is increased even further as a result of the oblique arrangement of the supporting arms 2 with respect to the edges of the fan impeller (as shown in FIG. 2).

Figure 5:
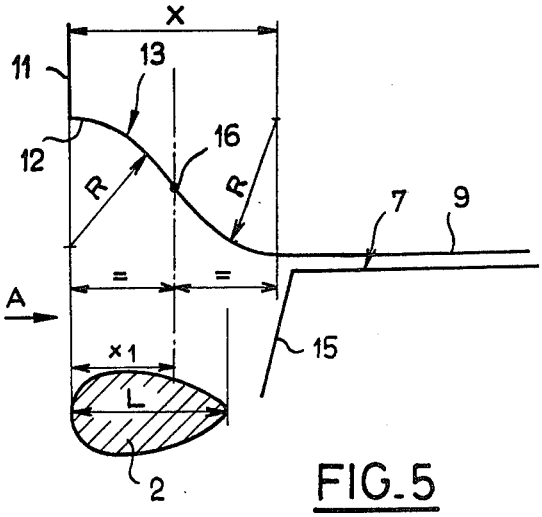
FIG. 5 is a portion of FIG. 1 in which are shown diagrammatically the respective positions of a supporting arm, of the fan impeller and of the junction portion.

Furthermore, the airstream filaments which extend along the supporting arms 2 have a tendency to break away from the arm profile when they have reached a point of travel corresponding to about two-thirds of said profile (namely the distance $x_1$ shown in FIG. 5). In point of fact, this breakaway region is located substantially opposite to the point of inflection 16 of the profile of the junction portion, that is, in the region in which the acceleration is of maximum value. The precise effect of this acceleration is to reduce the tendency toward breakaway, thereby ensuring higher aerodynamic efficiency of the fan.

Figure 15:
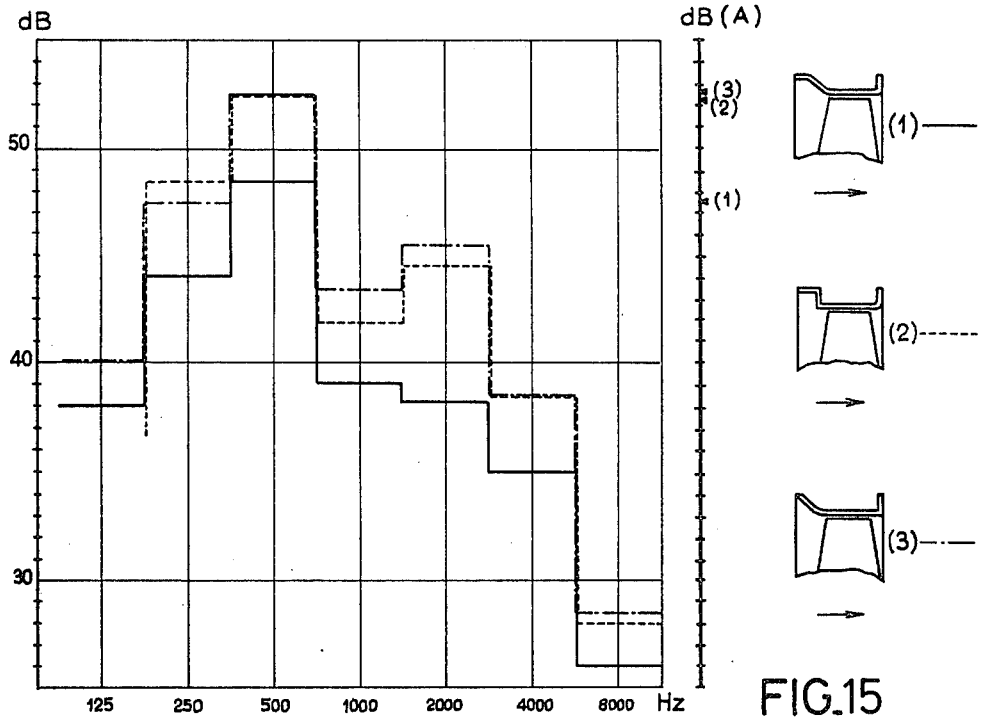
FIGS. 15 and 16 are experimental diagrams showing the noise attenuation obtained by means of the invention.

The improvements in noise reduction which are thus obtained can clearly be seen in the experimental diagram of FIG. 15 in which the respective sound levels are represented (in decibels) as a function of the frequency in hertz. These results have been obtained from three different designs of the junction portion which are illustrated for easier reference in the small adjacent figures, namely as follows:

(1) an S in accordance with the invention (full line);
(2) at 90° (dashed line);
(3) having a constant slope (chain-dotted line).

On the right-hand scale, there is shown the general sound level (in decibels) which is integrated on the entire frequency spectrum (in accordance with the weighting function designated as "A").

It can be observed that the noise level is considerably attenuated, in particular at intermediate audio frequencies from 500 to 2000 Hz.

A gain of about 4 dB is thus achieved in the vicinity of 500 Hz and in the vicinity of 1000 Hz and a gain of 7 dB is achieved in the vicinity of 2000 Hz.

Figure 13:
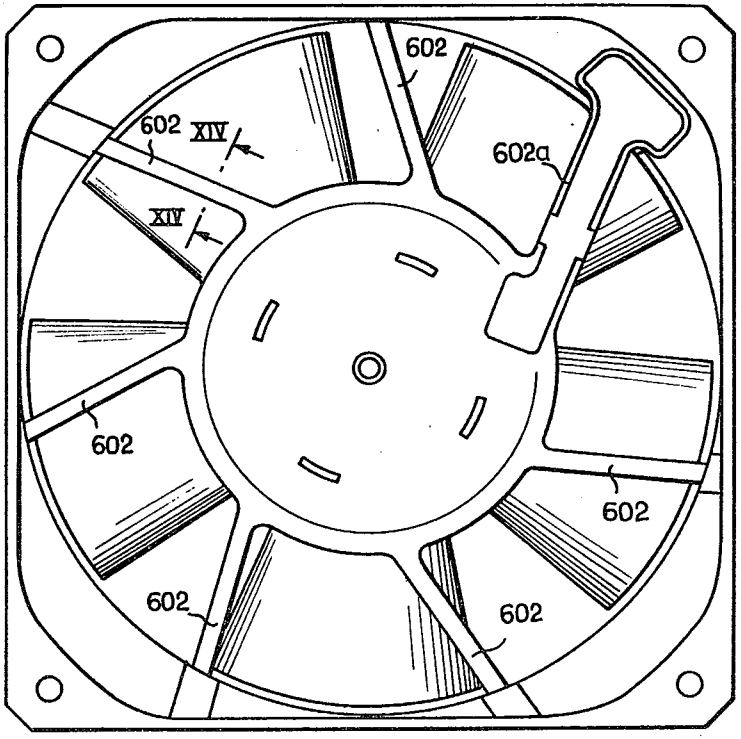
FIG. 13 is a view taken along line XIII—XIII of FIG. 12.
Figure 14:
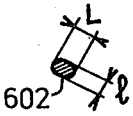
FIG. 14 is a view in cross-section taken along line XIV—XIV of FIG. 13.
Figure 12:
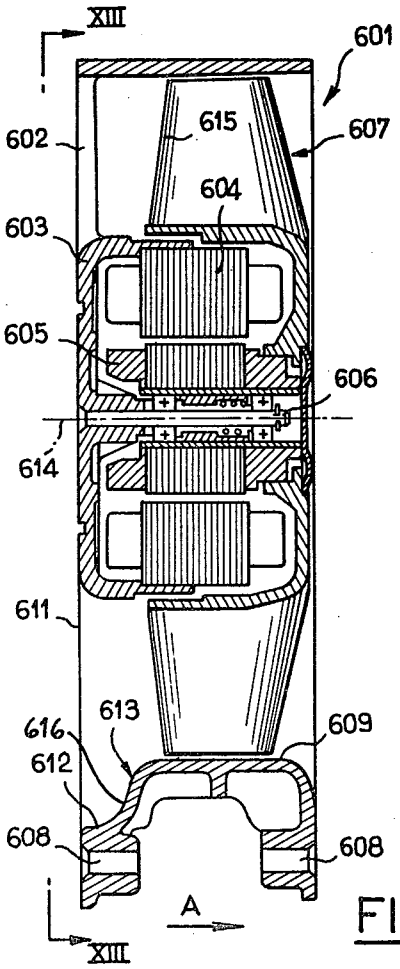
FIG. 12 is a view which is similar to FIG. 1 in an alternative embodiment.

An alternative embodiment will now be described with reference to FIGS. 12 to 14. This variant is similar to the embodiment described in the foregoing and the same reference numerals are again adopted in the figure but are increased by 600.

In this new embodiment, the axial length L of the supporting arms 602 is smaller with respect to the axial length X of the junction portion than in the preceding embodiment and does not exceed about one-quarter of said length ($L \leqq X/4$). Inasmuch as the portion 613 has the same profile as the portion 13 of FIGS. 1 to 5, the result thereby achieved is that the point of inflection 616 of the profile is located at a distance from the plane 612 of maximum cross-section of the junction portion corresponding to the air admission face of the fan which is approximately at least equal to double the length L. The supporting arms are therefore contained in the first quarter of the junction portion in which the air acceleration is still of low value and which is relatively remote from the leading edges 615 of the impeller blades. This has the effect of limiting the incidence on the noise level, of the airflow disturbance caused by the presence of the supporting arms.

In order to compensate for the reduction in cross-sectional length of the supporting arms while maintaining stable behavior of the motor and of the impeller within the fan housing, it usually proves necessary to provide a number of arms exceeding the usual number of three or four, thus having the advantage of reducing noise-generating vibrations by increasing the number of points of attachment of the motor.

The number of arms will be determined by those skilled in the art with due regard to mechanical requirements as well as to the number of impeller blades in order to prevent the appearance of audio frequencies produced by the passage of the impeller blades opposite to the supporting arms at values in the vicinity of 1000 Hz, which is already a loaded frequency.

A fan considered by way of example has external dimensions of 119×119×38 mm and a weight of 725 g in which the assembly consisting of fan housing, supporting arm and motor casing is fabricated by molding from the light alloy known as "Zamak". The junction portion has a length of 14 mm and the impeller has five blades. The fan can be provided with seven supporting arms 602 (as shown in FIG. 13), six of which have an axial length of 3 mm and a maximum width l of 2 mm. The seventh supporting arm 602*a* serves as an electric cable run and has larger dimensions (maximum length and width of 7 mm).

Fans of the type hereinabove described usually serve to blow cool air into an enclosure to be cooled and the arms 2 serve to support a filter located upstream of the fan.

If a fan is intended to extract hot air from an enclosure to be cooled, it is an advantage to employ the arms as finger guards in order to prevent accidents.

Figure 6:
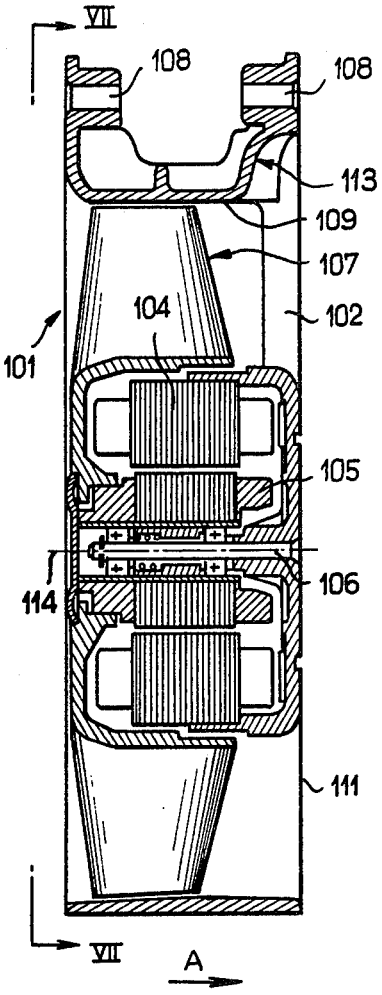
FIGS. 6 and 7 are views which are similar to FIGS. 1 and 2 but with the junction portion located on the discharge side.
Figure 7:
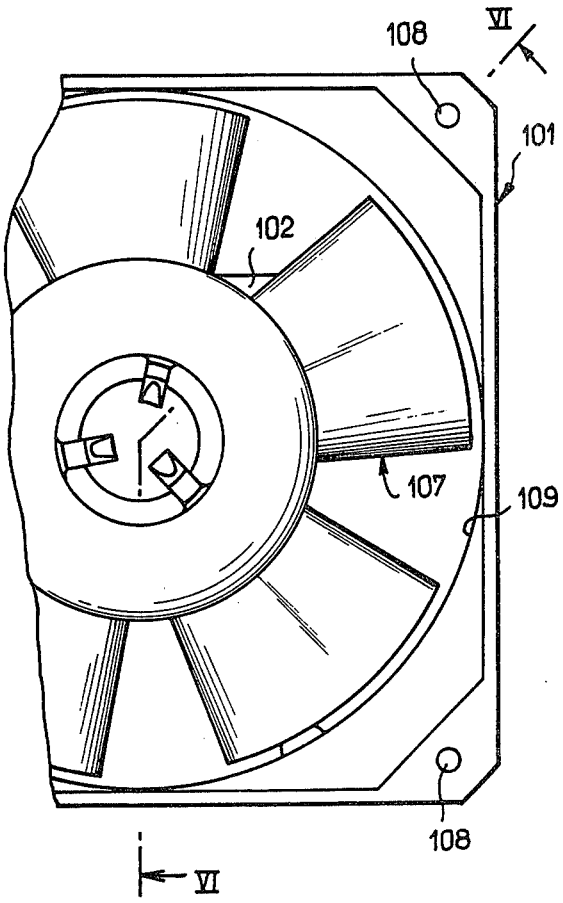

The arrangement just mentioned makes it necessary to place the arms at the level of the air outlet face in accordance with the embodiment shown in FIGS. 6 and 7.

As a first approximation, it could be considered that FIG. 1 has simply been turned-over (the left-hand side being thus located on the right) or else that the direction of the arrow A has been reversed. It is for this reason that the reference numerals of FIG. 1 have been increased by 100 in FIGS. 6 and 7. However, this "turn-over" reversal is not complete in all respects since it must not affect the impeller. The impeller blades must in fact remain unchanged with respect to the moving airstream. One of the consequences of said reversal is that the junction portion 113 having an S-shaped profile is now located in the vicinity of the air outlet face 111. In regard to the air which impinges on the supporting arms 102, the point of impact is located in the region of the point of inflection of the junction portion 113 or in other words in the region of maximum acceleration of the airflow.

Figure 16:
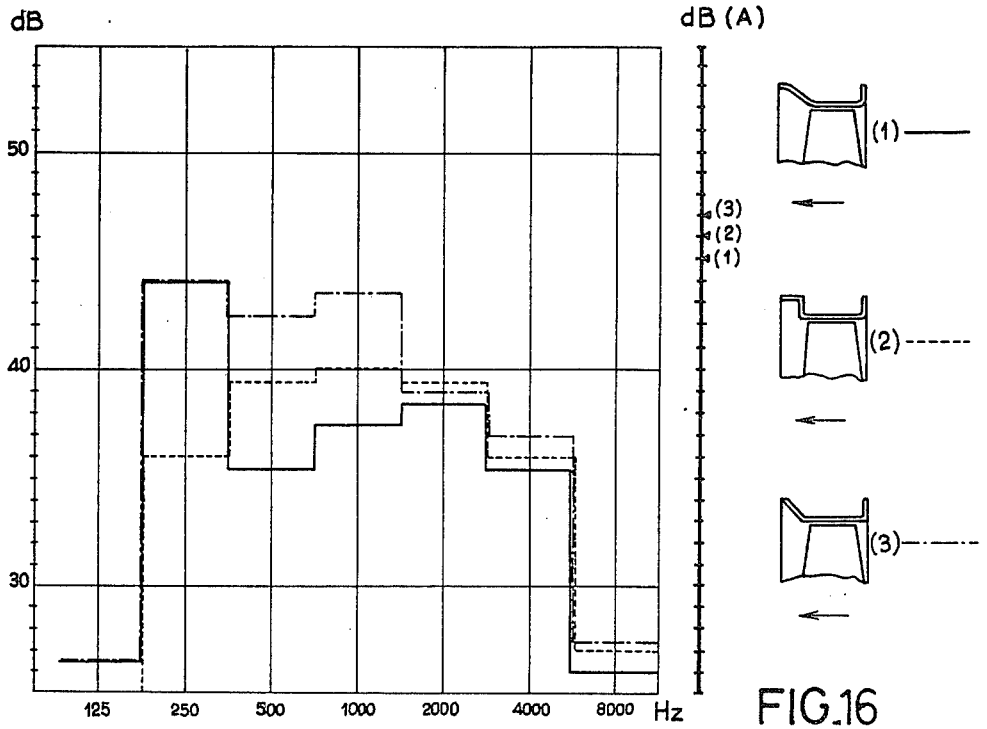

In spite of these important changes in the airflow, it is a surprising fact that the results observed in regard to the sound level are still very favorable as shown in the diagram of FIG. 16. The reduction, however, is less marked and more limited within the spectrum but located in the central portion of the audio-frequency band. Throughout the entire spectrum, the sound level is equal at a maximum to the level obtained by means of known devices.

In particular, a sound level reduction of 5 to 6 dB is observed in the vicinity of 500 Hz and 1000 Hz.

Figure 8:
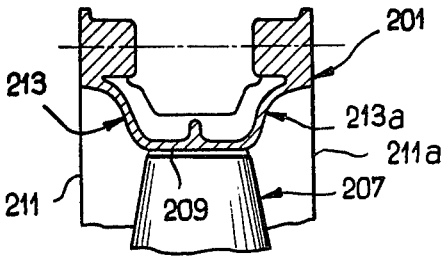
FIGS. 8 and 9 are fragmentary views in axial cross-section showing two alternative modes of arrangement of the impeller within the fan housing.

As a function of these results, steps are advantageously taken in accordance with the invention to provide two junction portions 213 and 213*a* (as shown in FIG. 8), one junction portion being located on the intake side and the other portion being located on the discharge side, respectively on the faces 211 and 211*a* of the fan housing 201.

Figure 9:
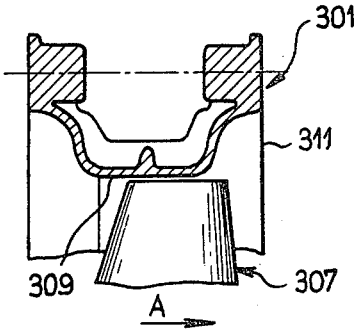

In all the embodiments described thus far, the peripheral edge of the impeller is entirely located opposite to the cylindrical portion 9, 109, 209 of the passageway formed by the fan housing. In an alternative embodiment shown in FIG. 9, the invention proposes to arrange the impeller 307 so that part of this latter projects beyond said cylindrical portion 309 on the side corresponding to the air outlet face 311. This arrangement makes it possible to take advantage of the centrifugal force in order to improve the flow in the corners of the fan housing.

Figure 10:
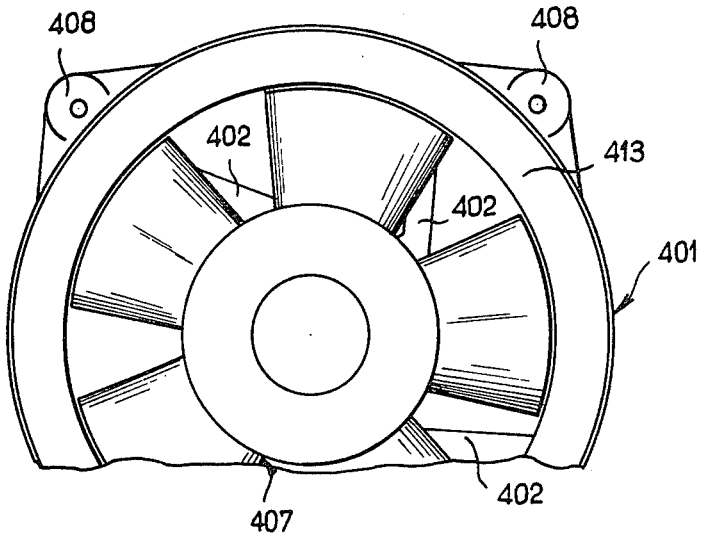
FIGS. 10 and 11 are front views of compact fan designs.

The use of a junction portion having an S-shaped profile produces its optimum effect in the case of a fan housing 401 which is entirely cylindrical (as shown in FIG. 10) and provided with only four mounting lugs 408. In this case, the junction portion 413 extends over the entire periphery of the fan housing.

Figure 11:
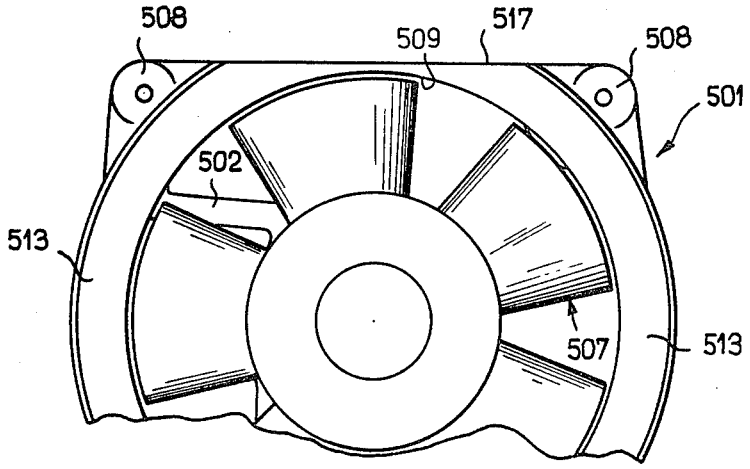

If it is intended to place a plurality of fans side by side within a small area, the cylindrical fan housing of the preceding embodiment is reduced in size by forming flat portions 517 (as shown in FIG. 11) which are approximately tangent to the cylindrical portion 509 of the duct. In this case, the junction portion 513 having an S-shaped profile is limited to two separate zones located within the regions which have not been reduced in size.

In all the alternative embodiments proposed, the reduction in sound level remains of the same order as in the foregoing.

As will readily be apparent, the invention is not limited to the examples hereinabove described but extends to any technological variant within the capacity of those versed in the art.

What is claimed is:

1. In an axial electric fan of the flat type comprising a housing having an air admission face and an air outlet face, the housing having a cylindrical portion, a plurality of supporting arms carried by the housing, a casing centrally of the fan and carried by said arms, a motor within said casing, said motor having a shaft, and an impeller mounted on the shaft and cooperating with said cylindrical portion, the housing having a duct therethrough that is defined in part by said cylindrical portion, said duct on at least one said face of the fan housing having a larger area than the cross-sectional area of said cylindrical portion; the improvement in which the duct has on at least part of its periphery between said cylindrical portion and said at least one face of the fan housing a junction portion having an S-shaped profile in an axial plane, the ends of the S being substantially parallel to the axis of rotation of the shaft, said duct being progressively greater width from said cylindrical portion to said at least one face of the fan housing, said S-shaped profile of the junction portion having a point of inflection, said supporting arms extending from said casing to said junction portion and having a decreasing width at least from said point of inflection toward said impeller.

2. A fan according to claim 1, wherein the junction portion terminates in the cylindrical portion of the duct substantially at the level of the impeller-blade edges located nearest the aforesaid face of the fan housing.

3. A fan according to claim 1, wherein the arms which support the fan-motor casing are approximately contiguous to the plane containing the largest cross-sectional area of the junction portion.

4. A fan according to claim 3, wherein the point of inflection of the S-shaped profile of the junction portion is located approximately at a point corresponding to at least double the cross-sectional length of the supporting arms along the axis of the fan starting from the plane of maximum cross-sectional area of said junction portion.

5. A fan according to claim 3, wherein the supporting arms extend towards the interior of the fan housing over approximately three-quarters of the axial length of the junction portion.

6. A fan according to claim 5, wherein said point of inflection is located substantially at the midpoint of the axial length of said junction portion.

7. A fan according to claim 1, wherein the arms which support the fan-motor casing have a cross-section of ovoid shape.

8. A fan according to claim 1, wherein the supporting arms have a triangular cross-section.

9. A fan according to claim 1, wherein the S-shaped profile comprises a circular arc which is continuously concave towards the axis of the fan and a circular arc which is continuously convex towards said axis, said arcs being joined to each other through said point of inflection of said profile.

10. A fan according to claim 1, wherein the fanhousing face at which the junction portion terminates is the air admission face.

11. A fan according to claim 1, wherein the fanhousing face at which the junction portion terminates is the air outlet face.

12. A fan according to claim 1, wherein the two faces of the fan housing are joined to the cylindrical portion which cooperates with the impeller by means of said junction portion having said S-shaped cross-section.

* * * * *